US009248338B2

(12) United States Patent
Lo

(10) Patent No.: US 9,248,338 B2
(45) Date of Patent: Feb. 2, 2016

(54) ELLIPTICAL EXERCISE MACHINE

(71) Applicant: Chiu Hsiang Lo, Taichung (TW)

(72) Inventor: Chiu Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 80 days.

(21) Appl. No.: 14/159,092

(22) Filed: Jan. 20, 2014

(65) Prior Publication Data

US 2015/0202488 A1 Jul. 23, 2015

(51) Int. Cl.
*A63B 22/04* (2006.01)
*A63B 22/06* (2006.01)

(52) U.S. Cl.
CPC ..... *A63B 22/04* (2013.01); *A63B 22/0664* (2013.01)

(58) Field of Classification Search
CPC ..... A63B 22/0002; A63B 22/0007; A63B 22/001; A63B 22/0015; A63B 22/0023; A63B 22/0046; A63B 22/04; A63B 22/06; A63B 22/0664; A63B 2022/0017; A63B 2022/002; A63B 2022/0025; A63B 2022/0043; A63B 2022/067; A63B 2022/0676; A63B 23/035; A63B 23/03516; A63B 23/03533; A63B 23/03541; A63B 23/03575; A63B 23/03591; A63B 23/04; A63B 23/0405; A63B 23/0417; A63B 23/0423; A63B 23/12; A63B 23/1209; A63B 2208/0204; A63B 2208/0209; A63B 2225/09
See application file for complete search history.

(56) References Cited

U.S. PATENT DOCUMENTS

| | | | | | |
|---|---|---|---|---|---|
| 5,836,854 | A * | 11/1998 | Kuo | 482/52 |
| 5,919,118 | A * | 7/1999 | Stearns et al. | 482/51 |
| 5,993,359 | A * | 11/1999 | Eschenbach | 482/57 |
| 6,042,512 | A * | 3/2000 | Eschenbach | 482/52 |
| 6,045,488 | A * | 4/2000 | Eschenbach | 482/52 |
| 6,053,847 | A * | 4/2000 | Stearns et al. | 482/51 |
| 6,077,196 | A * | 6/2000 | Eschenbach | 482/51 |
| 6,168,552 | B1 * | 1/2001 | Eschenbach | 482/52 |
| 6,248,046 | B1 * | 6/2001 | Maresh et al. | 482/57 |
| 6,416,442 | B1 * | 7/2002 | Stearns et al. | 482/52 |
| 6,579,210 | B1 * | 6/2003 | Stearns et al. | 482/52 |
| 6,645,125 | B1 * | 11/2003 | Stearns et al. | 482/52 |
| 6,719,666 | B1 * | 4/2004 | Lo et al. | 482/52 |
| 7,041,034 | B1 * | 5/2006 | Stearns et al. | 482/52 |
| 7,425,189 | B1 * | 9/2008 | Eschenbach | 482/52 |
| 7,448,986 | B1 * | 11/2008 | Porth | 482/52 |
| 7,682,293 | B2 * | 3/2010 | Eschenbach | 482/62 |
| 7,785,236 | B1 * | 8/2010 | Lo | 482/63 |
| 8,113,995 | B1 * | 2/2012 | Hsu | 482/52 |
| 2001/0036886 | A1 * | 11/2001 | Eschenbach | 482/142 |
| 2002/0019298 | A1 * | 2/2002 | Eschenbach | 482/51 |
| 2002/0119867 | A1 * | 8/2002 | Stearns et al. | 482/52 |
| 2002/0123411 | A1 * | 9/2002 | Stearns et al. | 482/52 |
| 2003/0236152 | A1 * | 12/2003 | Lo et al. | 482/52 |

(Continued)

*Primary Examiner* — Oren Ginsberg
*Assistant Examiner* — Gary D Urbiel Goldner

(57) ABSTRACT

An elliptical exercise machine includes a frame, an impedance unit, two linkage units and a stride-adjusting unit. The impedance unit includes a flywheel supported on the frame and two cranks connected to the flywheel. Each linkage unit includes a rocking element and a moving element. The rocking element includes an upper end and a lower end. The moving element includes a rear end and a front end connected to the lower end of the rocking element. The stride-adjusting unit includes a threaded rod and a carrier. The threaded rod is supported on the frame. The carrier is connected to the upper end of the rocking element and formed with a screw hole for receiving the threaded rod so that the threaded rod can rotate to move the carrier and the upper end of the rocking element to adjust a stride of the elliptical exercise machine.

6 Claims, 8 Drawing Sheets

(56) References Cited

U.S. PATENT DOCUMENTS

| | | | | |
|---|---|---|---|---|
| 2004/0097339 | A1* | 5/2004 | Moon | 482/52 |
| 2004/0097340 | A1* | 5/2004 | Liao et al. | 482/52 |
| 2005/0026751 | A1* | 2/2005 | Lo | 482/52 |
| 2005/0164835 | A1* | 7/2005 | Porth | 482/52 |
| 2005/0181911 | A1* | 8/2005 | Porth | 482/52 |
| 2006/0009330 | A1* | 1/2006 | Lo | 482/52 |
| 2006/0250753 | A1* | 11/2006 | Lui et al. | 361/600 |
| 2007/0060449 | A1* | 3/2007 | Lo | 482/52 |
| 2007/0060450 | A1* | 3/2007 | Lo | 482/52 |
| 2007/0117683 | A1* | 5/2007 | Ercanbrack et al. | 482/52 |
| 2008/0032869 | A1* | 2/2008 | Pacheco et al. | 482/52 |
| 2008/0051258 | A1* | 2/2008 | Schmehl et al. | 482/52 |
| 2008/0161166 | A1* | 7/2008 | Lo | 482/52 |
| 2009/0209395 | A1* | 8/2009 | Maresh et al. | 482/52 |
| 2010/0137111 | A1* | 6/2010 | Van Handel et al. | 482/52 |
| 2012/0088634 | A1* | 4/2012 | Heidecke | 482/2 |
| 2012/0088635 | A1* | 4/2012 | Lee et al. | 482/52 |
| 2012/0108402 | A1* | 5/2012 | Rodgers, Jr. | 482/110 |
| 2013/0143720 | A1* | 6/2013 | Chuang et al. | 482/52 |
| 2013/0244837 | A1* | 9/2013 | Chen | 482/52 |
| 2014/0042725 | A1* | 2/2014 | Lo | 280/281.1 |
| 2014/0148312 | A1* | 5/2014 | Lo | 482/57 |
| 2015/0018173 | A1* | 1/2015 | Lo | 482/57 |
| 2015/0057129 | A1* | 2/2015 | Lo | 482/52 |
| 2015/0119201 | A1* | 4/2015 | Chang | 482/52 |

* cited by examiner

ELLIPTICAL EXERCISE MACHINE

BACKGROUND OF INVENTION

1. Field of Invention

The present invention relates to an elliptical exercise machine and, more particularly, to an elliptical exercise machine capable of providing an adjustable stride.

2. Related Prior Art

There are various types of exercise machines to help users exercise various parts of their bodies. For example, there are treadmills and elliptical exercise machines. An elliptical exercise machines provides an elliptical trace of movement for a user.

An elliptical exercise machine includes a frame, two linkage units and an impedance unit. The frame includes a post supported on a base. The impedance unit is supported on the base and connected to the linkage units. For example, the impedance unit includes a belt wound on a flywheel. The linkage units are placed on two opposite sides of the frame. Each of the linkage units includes a rocking element, a moving element and a pedal. The rocking element includes an upper end connected to the post and a lower end connected to a front end of the moving element. The moving element includes a portion connected to a crank connected to the flywheel. A user sets his or her feet on the pedals of the linkage units and moves the feet along substantially elliptical paths. All users are limited to a common stride since the distance between two ends of each of the substantially elliptical paths is constant although tall users generally want long strides while short users like short strides.

Therefore, the present invention is intended to obviate or at least alleviate the problems encountered in prior art.

SUMMARY OF INVENTION

It is the primary objective of the present invention to provide an elliptical exercise machine with an adjustable stride.

To achieve the foregoing objective, the elliptical exercise machine includes a stride-adjusting unit in addition to a frame, an impedance unit and two linkage units. The frame includes a post supported on a base. The impedance unit includes a flywheel supported on the base and two cranks connected to the flywheel. Each linkage unit includes a rocking element and a moving element. The rocking element includes an upper end and a lower end. The moving element includes a rear end and a front end connected to the lower end of the rocking element. The stride-adjusting unit includes a threaded rod and a carrier. The threaded rod is supported on the post. The carrier is connected to the upper end of the rocking element and formed with a screw hole for receiving the threaded rod so that the threaded rod can rotate to move the carrier and the upper end of the rocking element to adjust a stride of the elliptical exercise machine.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
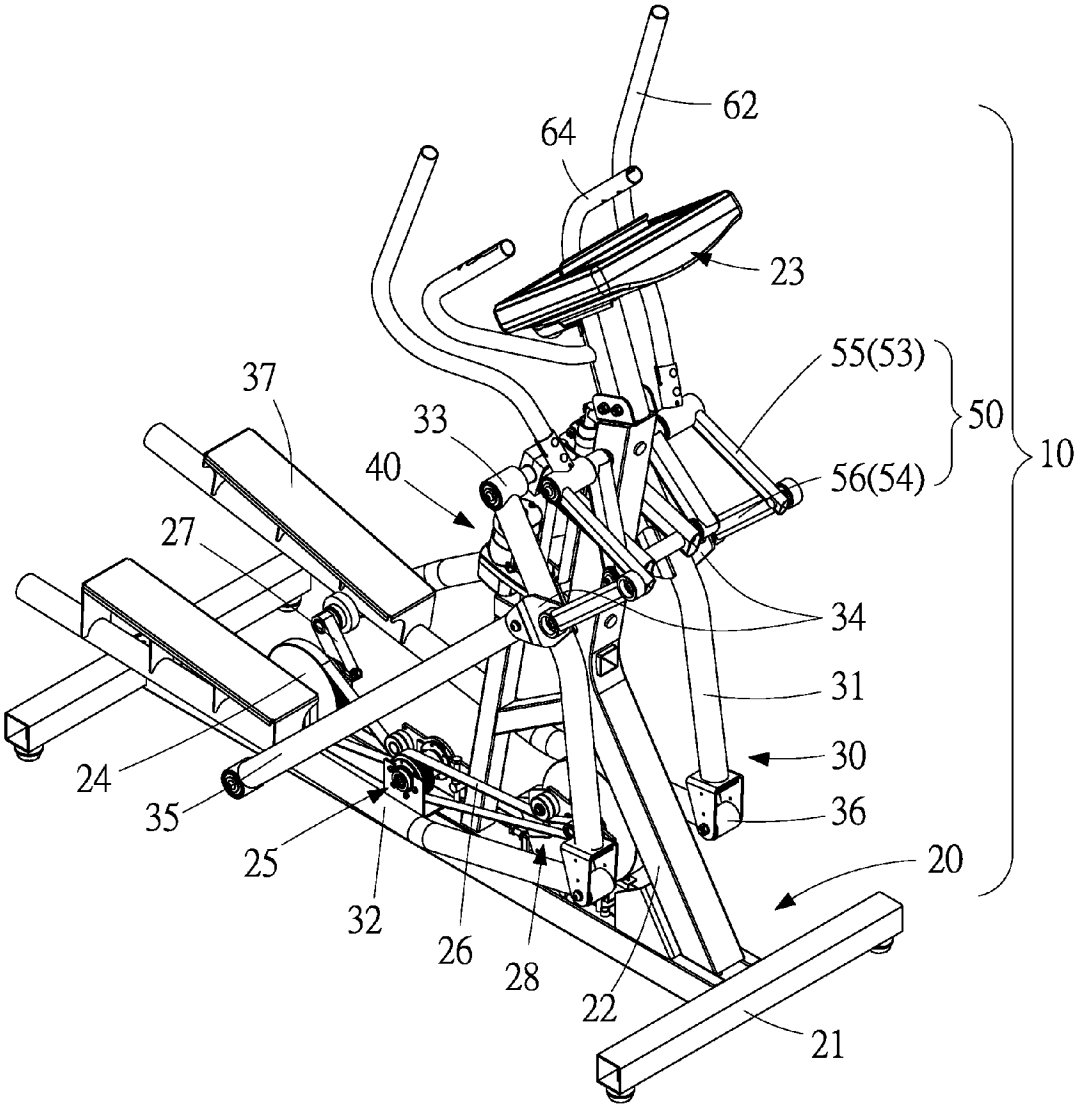
FIG. 1 is a perspective view of an elliptical exercise machine according to the preferred embodiment of the present invention.
Figure 2:
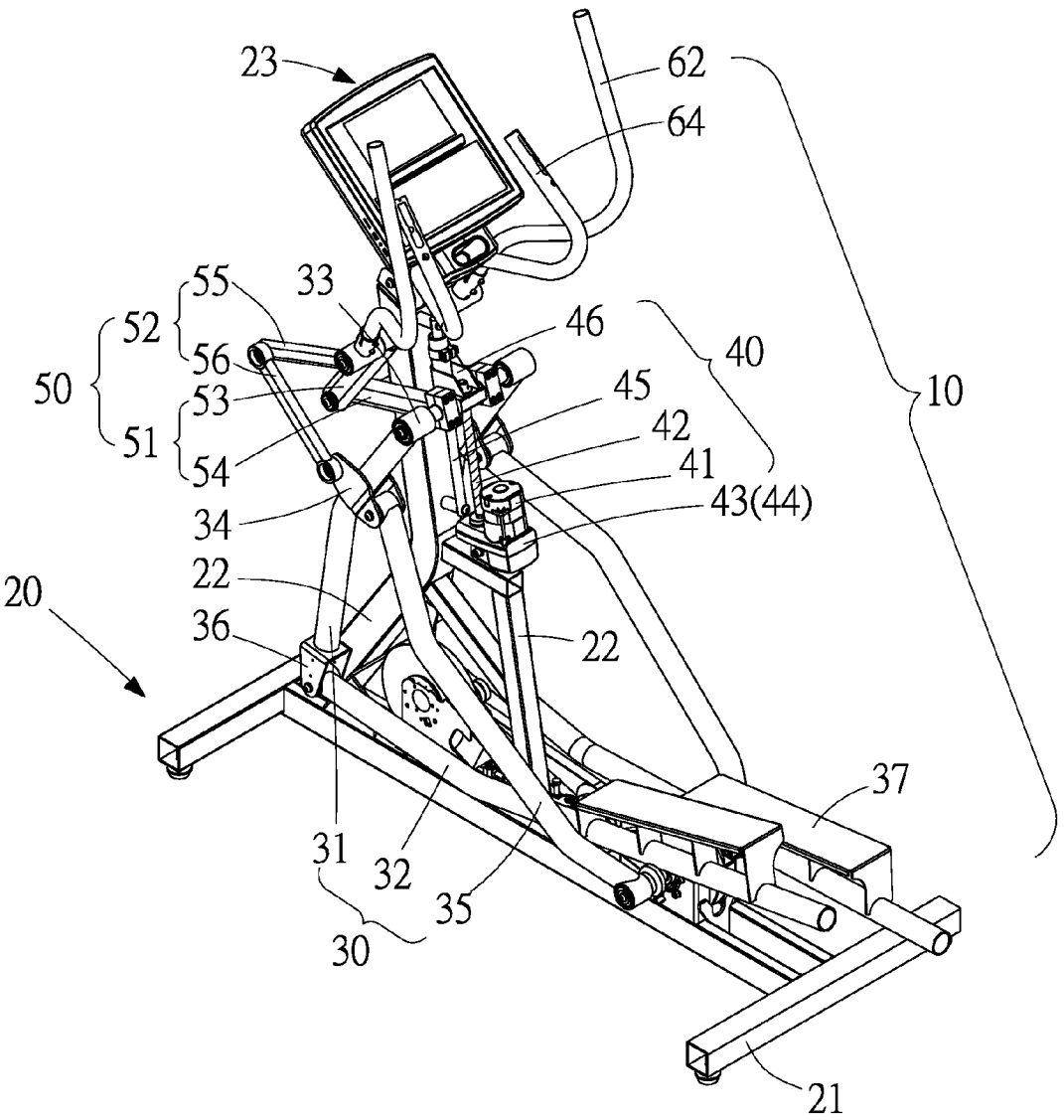
FIG. 2 is another perspective view of the elliptical exercise machine shown in FIG. 1.
Figure 3:
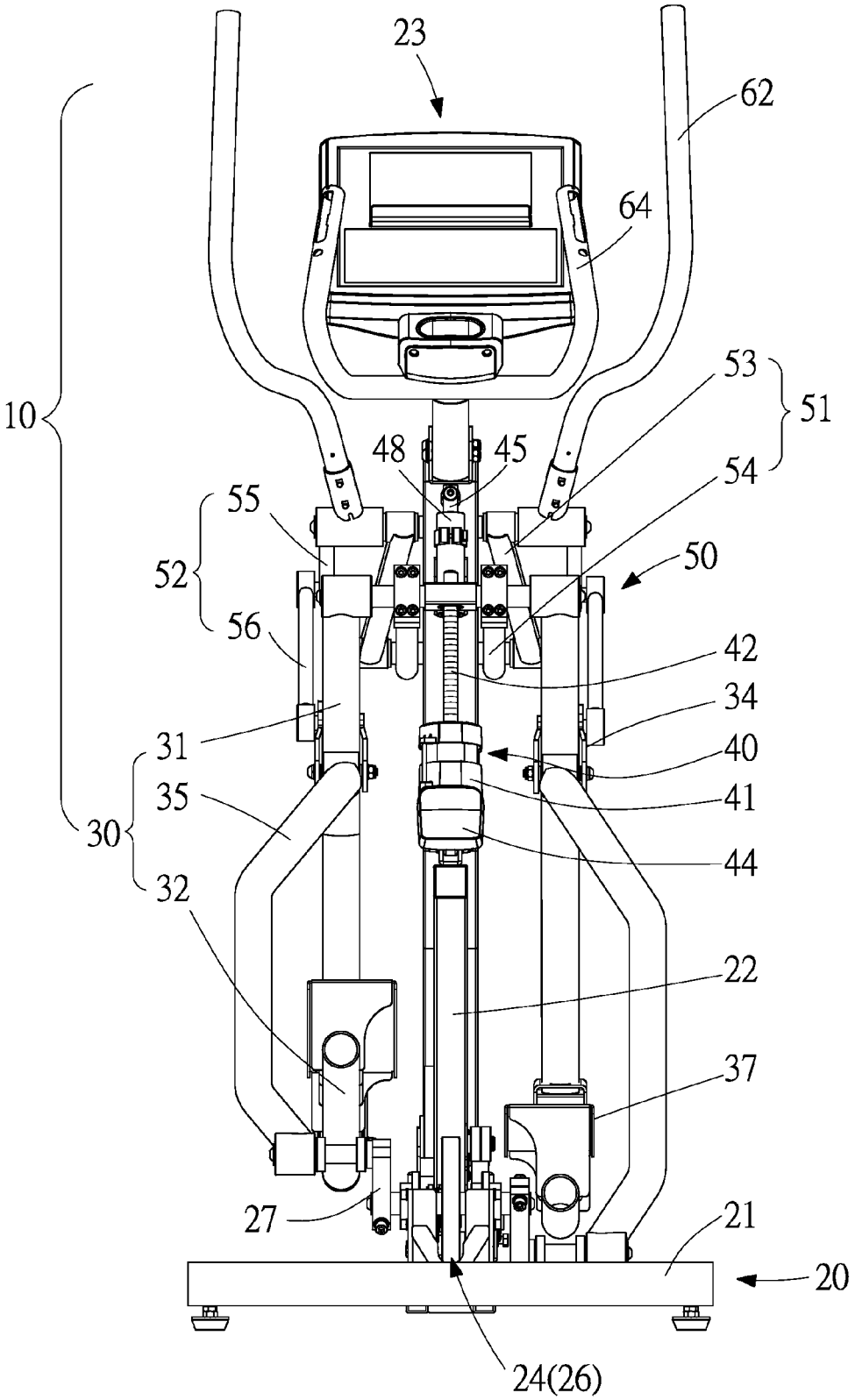
FIG. 3 is a rear view of the elliptical exercise machine illustrated in FIG. 2.

Referring to FIGS. 1 through 3, an elliptical exercise machine 10 includes a frame 20, two linkage units 30, a stride-adjusting unit 40 and an impedance unit according to the preferred embodiment of the present invention. The frame 20 includes a base 21 and a post 22. The base 21 includes a longitudinal bar connected to two transverse bars at two opposite ends. The post 22 includes a lower end connected to the longitudinal bar of the base 21 and an upper end for supporting a control panel 23.

The impedance unit includes a flywheel 24, a motor-driven pulley 28, an intermediate pulley set 25, two belts 26 and two cranks 27. The flywheel 24 is supported on longitudinal bar of the base 21. The flywheel 24 is operatively connected to the intermediate pulley set 25 via one of the belts 26. The intermediate pulley set 25 is operatively connected to the motor-driven pulley 28 via the other belt 26. Each of the cranks 27 includes a first end connected to the flywheel 24, The linkage units 30 are placed on two opposite sides of the frame 20. Each of the linkage units 30 includes a rocking element 31, a moving element 32, an auxiliary element 35, two joints 34 and 36, and a pedal 37. The rocking element 31 is formed with an upper end 33 connected to the stride-adjusting unit 40 and a lower end connected to a front end of the moving element 32 via the joint 36. The moving element 32 is movably supported on a second end of a corresponding one of the cranks 27. The auxiliary element 35 includes an upper end connected to a portion of the rocking element 31 via the joint 34 and a lower end connected to the second end of a corresponding one of the cranks 27. The pedal 37 is supported on the moving element 32.

Figure 4:
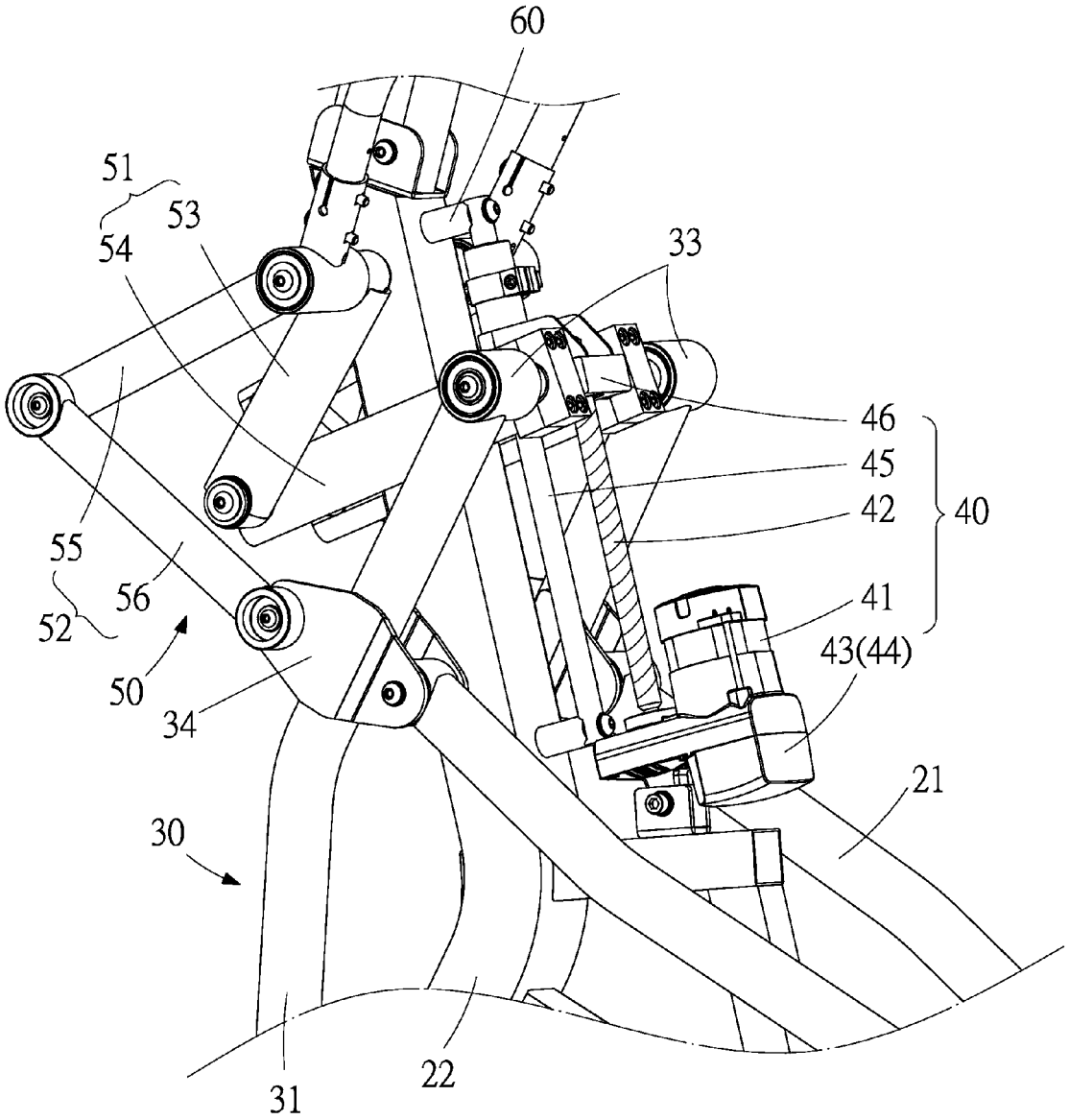
FIG. 4 is an enlarged partial view of the elliptical exercise machine shown in FIG. 2.
Figure 5:
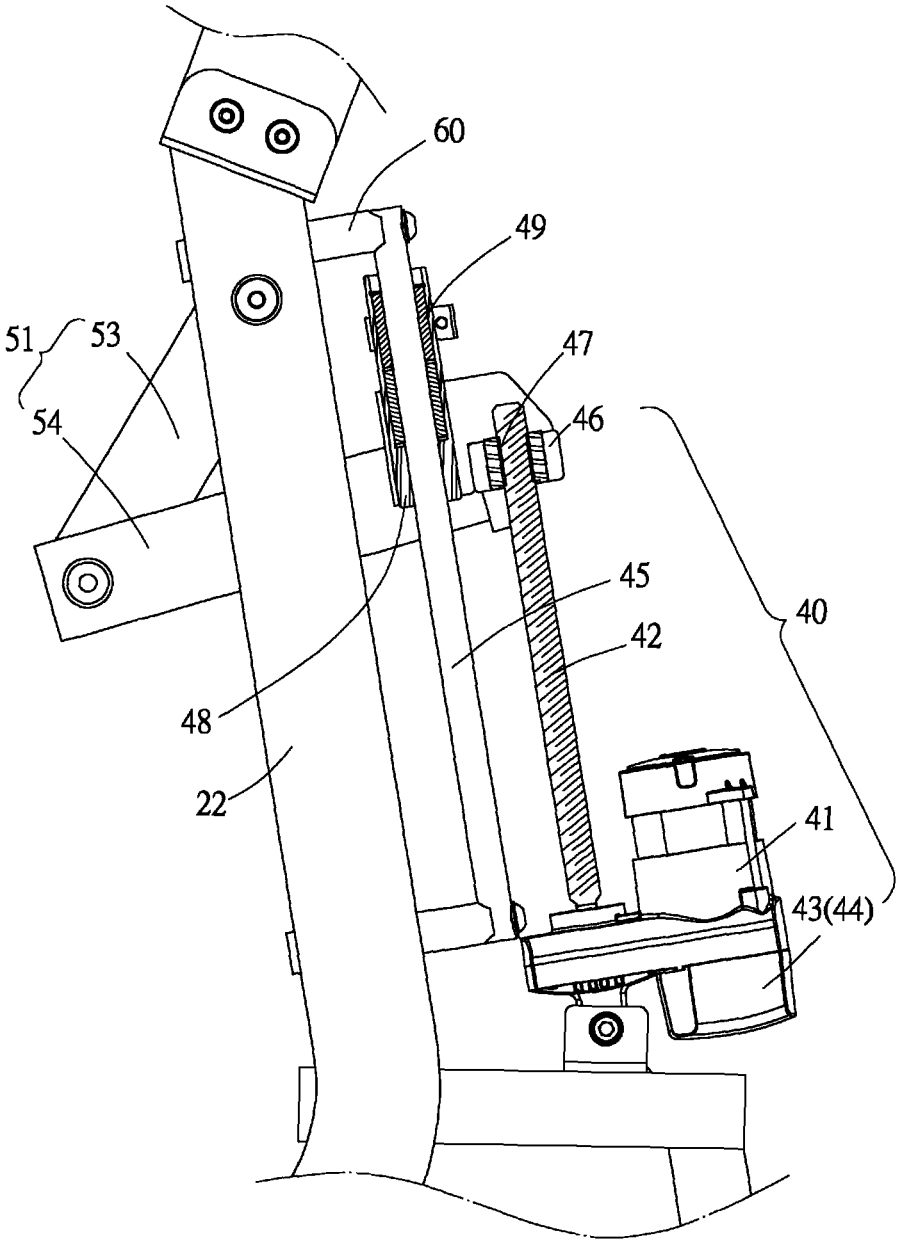
FIG. 5 is an enlarged partial side view of the elliptical exercise machine shown in FIG. 2.
Figure 6:
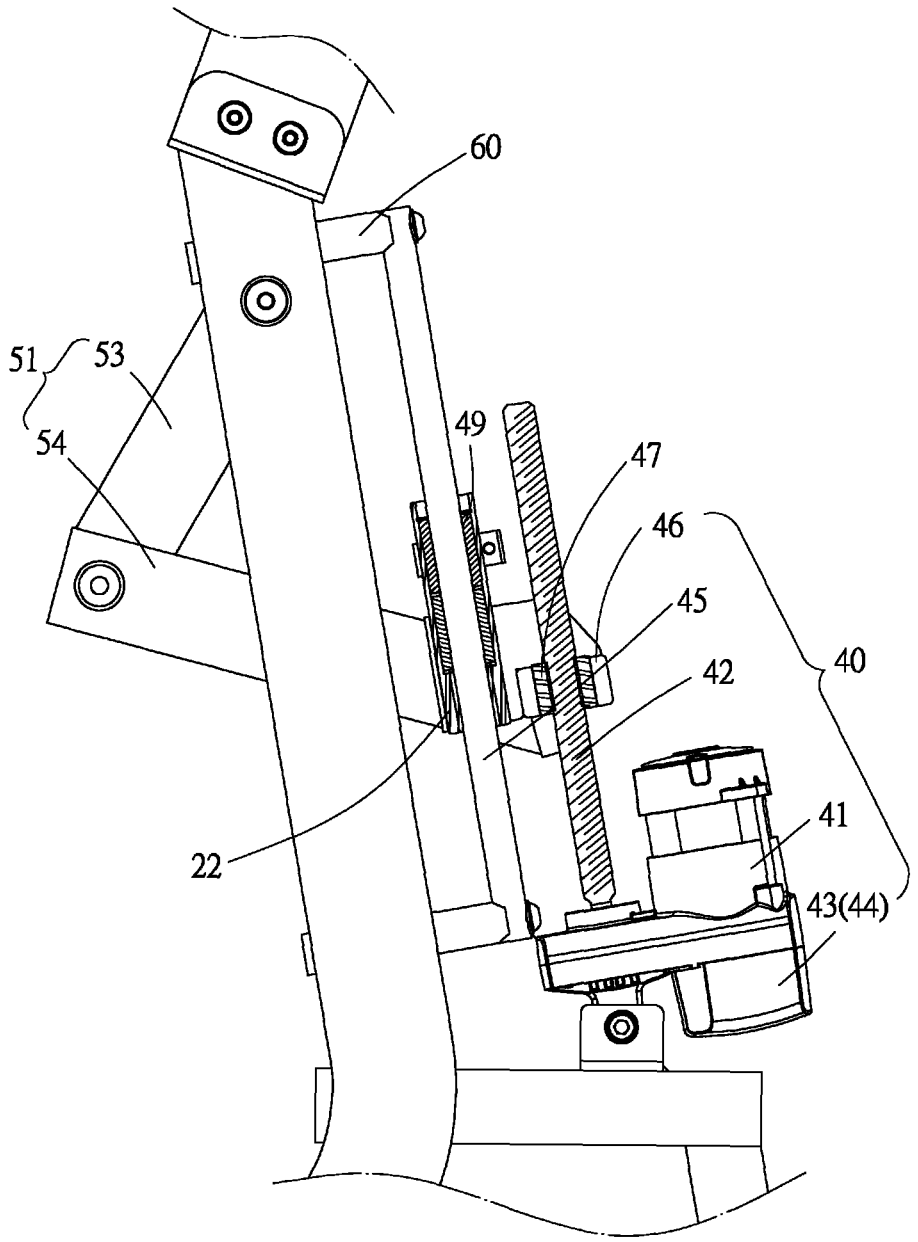
FIG. 6 is an enlarged partial side view of the elliptical exercise machine in another position than shown in FIG. 5.

Referring to FIGS. 4 through 6, the stride-adjusting unit 40 includes a motor 41, a threaded rod 42, a transmission 43, a guiding element 45 and a carrier 46. The motor 41 is operatively connected to the threaded rod 42 via the transmission 43. The transmission 43 includes a gear train placed in a shell 44 supported on a beam (not numbered) attached to the post 22. The motor 41 is supported on the shell 44.

The carrier 46 includes a screw hole 47, two axles (not numbered), a sleeve 48, and two linings 49. The axles are formed on two opposite sides of the carrier 46. Each of the axles of the carrier 46 is connected to the upper end 33 of the rocking element 31 of a corresponding one of the linkage units 30. The sleeve 48 is formed on a front portion of the carrier 46. The screw hole 47 receives the threaded rod 42. The sleeve 48 includes an axis extending parallel to the axis of the threaded rod 42. The linings 49 are inserted in the sleeve 48.

The guiding element 45 is in the form of a rod. The guiding element 45 includes an upper end connected to the post 22 by a beam 60 and a lower end connected to the post by another beam 60. The guiding element 45 is inserted in the linings 49 that ensure smooth movement of the sleeve 48 along the guiding element 45.

Preferably, the elliptical exercise machine 10 further includes two primary handle units 50 each including a primary handle 62, an internal linkage set 51 and an external linkage set 52. The internal linkage set 51 includes two bars 53 and 54. The bar 54 includes an end connected to a corresponding one of the axles of the carrier 46 and another end connected to an end of the bar 53. The external linkage set 52 includes two bars 55 and 56. The bar 56 includes an end connected to the joint 34 of a corresponding one of the linkage units 30 and another end connected to an end of the bar 55. Another end of the bar 55 is connected to another end of the bar 53. The primary handle 62 includes a lower end connected to the bar 55 so that the primary handle 62 pivots together with the bar 55.

Preferably, the elliptical exercise machine 10 further includes two secondary handles 64 connected to two opposite sides of the post 22. Each of the secondary handles 64 is formed with a lower end connected to the post 22.

The motor 41 can be turned on to rotate the threaded rod 42 via the transmission 43. Accordingly, the carrier 46 is moved along the guiding element 45 between an upper limit and a lower limit, and so is the upper end 33 of the rocking element 31 of each of the linkage units 30.

Figure 7:
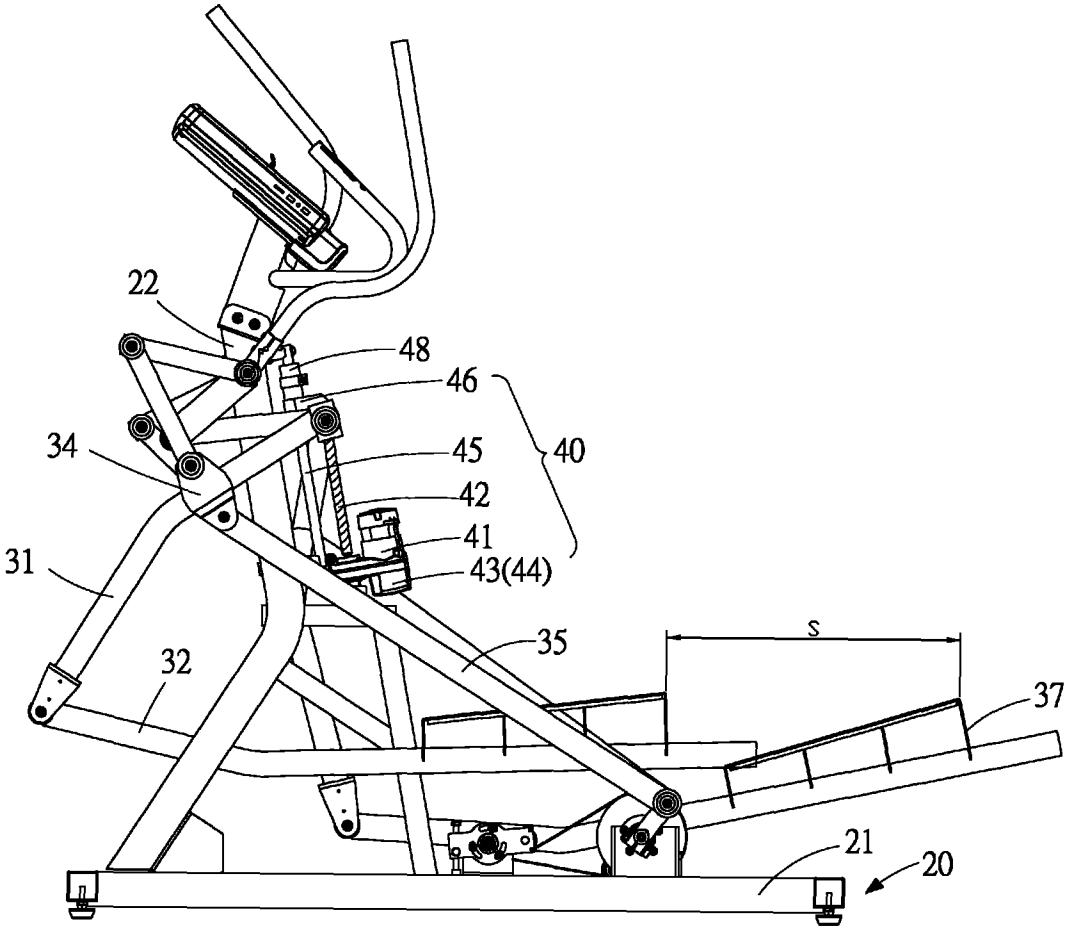
FIG. 7 is a side view of the elliptical exercise machine illustrated in FIG. 5.

Referring to FIGS. 5 and 7, the carrier 46 is placed at the upper limit, and so is the upper end 33 of the rocking element 31 of each of the linkage units 30. One of the pedals 37 is placed at a front limit of its movement while the other pedal 37 is placed a rear limit of its movement. Now, the distance between the pedals 37 is defined as the stride S.

Figure 8:
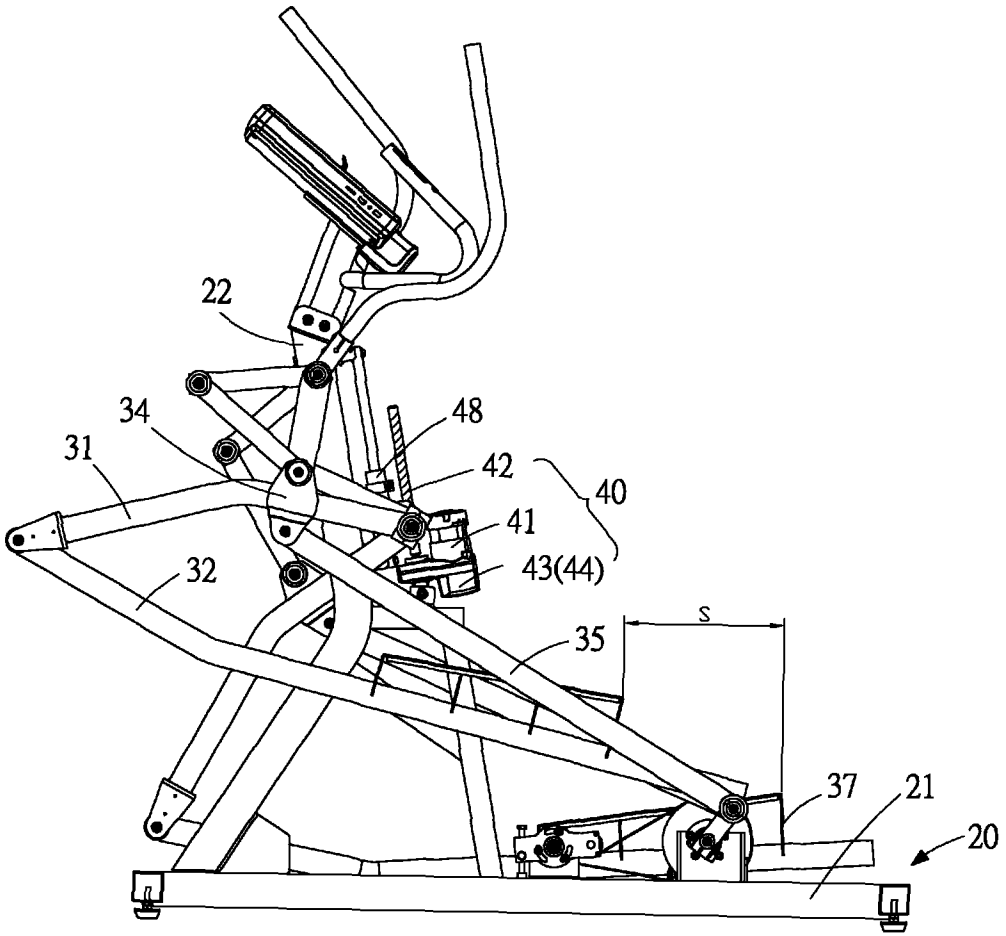
FIG. 8 is a side view of the elliptical exercise machine in another position than shown in FIG. 6.

Referring to FIGS. 6 and 8, the carrier 46 is placed at the lower limit, and so is the upper end 33 of the rocking element 31 of each of the linkage units 30. The stride S shown in FIGS. 6 and 8 is shorter than the stride S shown in FIGS. 5 and 7.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An elliptical exercise machine including:

a frame including a base and a post supported on the base;

an impedance unit including a flywheel supported on the base and two cranks connected to the flywheel;

two linkage units each including:

a rocking element including an upper end and a lower end;

a moving element including a rear end and a front end connected to the lower end of the rocking element;

an auxiliary element including an upper end and a lower end connected to a corresponding one of the cranks; and a joint for connecting the upper end of the auxiliary element to the rocking element;

a stride-adjusting unit including:

a threaded rod supported on the post; and a carrier connected to the upper end of the rocking element and formed with a screw hole for receiving the threaded rod so that the threaded rod can rotate to move the carrier and the upper end of the rocking element to adjust a stride of the elliptical exercise machine; and two primary handle units each including:

a primary handle;

a front bar;

a rear bar including an end connected to an end of the front bar and another end connected to the carrier;

an upper bar including an end connected to another end of the front bar; and a lower bar including an end connected to another end of the upper bar and another end connected to the joint of a corresponding one of the linkage units.

2. The elliptical exercise machine according to claim 1, wherein the stride-adjusting unit includes a guiding element supported on the post, wherein the carrier includes a sleeve movably placed on the guiding element to guide the carrier and the upper end of the rocking element to move rectilinearly.

3. The elliptical exercise machine according to claim 2, wherein the carrier includes a lining placed between the sleeve and the guiding element to ensure smooth movement of the sleeve along the guiding element.

4. The elliptical exercise machine according to claim 1, wherein in each of the primary handle units, the primary handle includes a lower end connected to the upper bar so that the primary handle pivots together with the upper bar.

5. The elliptical exercise machine according to claim 1, including two secondary handles connected to two opposite sides of the post.

6. The elliptical exercise machine according to claim 5, wherein each of the secondary handles includes a lower end connected to the post.

* * * * *